US009348312B2

(12) United States Patent
Gruenig

(10) Patent No.: US 9,348,312 B2
(45) Date of Patent: May 24, 2016

(54) TIMEPIECE LEVER

(71) Applicant: ETA SA Manufacture Horlogere Suisse, Grenchen (CH)

(72) Inventor: Daniel Gruenig, Sugiez (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/693,126

(22) Filed: Apr. 22, 2015

(65) Prior Publication Data

US 2015/0331390 A1 Nov. 19, 2015

(30) Foreign Application Priority Data

May 14, 2014 (EP) ..... 14168330

(51) Int. Cl.

| | |
|---|---|
| ***G04B 15/14*** | (2006.01) |
| ***G04B 1/00*** | (2006.01) |
| ***G04B 19/25*** | (2006.01) |
| ***G04B 15/08*** | (2006.01) |
| ***G04B 11/00*** | (2006.01) |
| *G04B 27/04* | (2006.01) |

(52) U.S. Cl.

CPC ..... *G04B 15/08* (2013.01); *G04B 11/003* (2013.01); *G04B 15/14* (2013.01); *G04B 19/25* (2013.01); *G04B 27/04* (2013.01)

(58) Field of Classification Search

CPC .... G04B 11/00; G04B 11/003; G04B 19/202; G04B 19/25; G04B 27/02; G04B 27/04

USPC ..... 368/34–36, 190–192, 196–197, 199

See application file for complete search history.

(56) References Cited

U.S. PATENT DOCUMENTS

| | | | | | |
|---|---|---|---|---|---|
| 3,470,687 | A | * | 10/1969 | Noriyuki | G04B 19/25 368/32 |
| 3,775,966 | A | | 12/1973 | Matsuura | |
| 3,844,107 | A | * | 10/1974 | Guyot | G04B 27/005 368/192 |
| 3,848,400 | A | * | 11/1974 | Fluck | G04B 19/25 368/193 |
| 3,983,691 | A | * | 10/1976 | Schaller | G04B 27/02 368/31 |

(Continued)

FOREIGN PATENT DOCUMENTS

| | | |
|---|---|---|
| CH | 706 266 A2 | 9/2013 |
| EP | 2 701 014 A1 | 2/2014 |

(Continued)

OTHER PUBLICATIONS

European Search Report issued Feb. 9, 2015 in European Application 14168330 filed on May 14, 2014 (with English Translation).

*Primary Examiner* — Vit W Miska

(74) *Attorney, Agent, or Firm* — Oblon, McClelland, Maier & Neustadt, L.L.P.

(57) ABSTRACT

Timepiece lever for the transmission of motion between a transmitter wheel set and a receiver wheel set pivoting about distinct first and second axes of the lever which includes a pivoting plate carrying a transmission means remote from the first axis and of variable angular position relative to the first axis and which includes a control finger-piece or a transmission wheel set, the lever also including a frictional connection between a first friction surface of the transmitter wheel set and a second friction surface of the pivoting plate, the element carrying the first friction surface is elastic and the element carrying the second friction surface is elastic.

20 Claims, 2 Drawing Sheets

(56) References Cited

U.S. PATENT DOCUMENTS

| | | | | |
|---|---|---|---|---|
| 6,295,249 | B1 * | 9/2001 | Takahashi | G04B 27/06 368/190 |
| 2008/0259741 | A1 * | 10/2008 | Goeller | G04B 13/005 368/199 |
| 2013/0250737 | A1 * | 9/2013 | Villar | G04B 19/25 368/15 |
| 2014/0056112 | A1 | 2/2014 | Villaret | |

FOREIGN PATENT DOCUMENTS

| | | |
|---|---|---|
| FR | 2 144 826 | 2/1973 |
| FR | 2 289 947 | 5/1976 |
| GB | 1 365 428 | 9/1974 |

* cited by examiner

Fig. 3
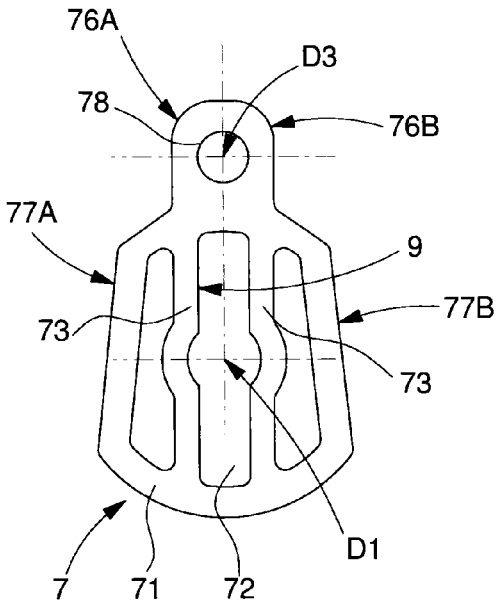
Fig. 4
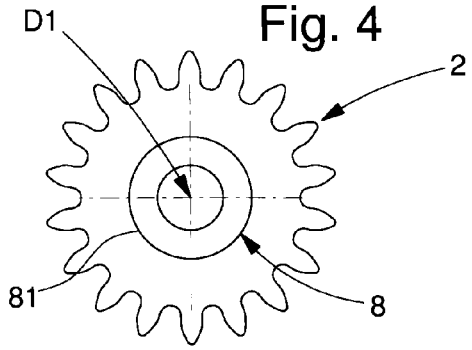
Fig. 5
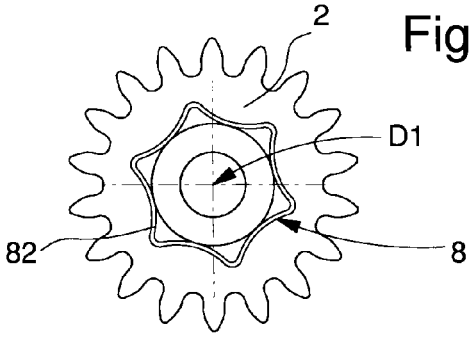
Fig. 6
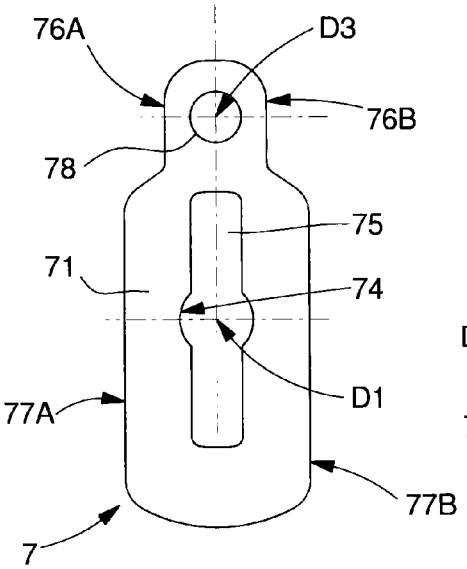
Fig. 7
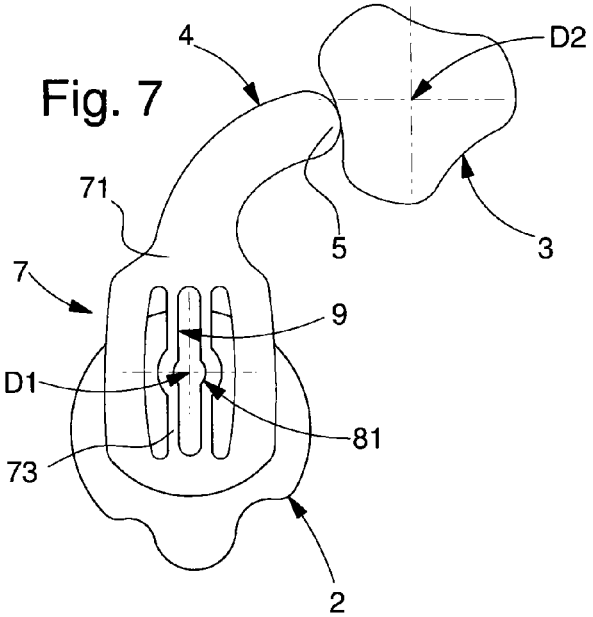
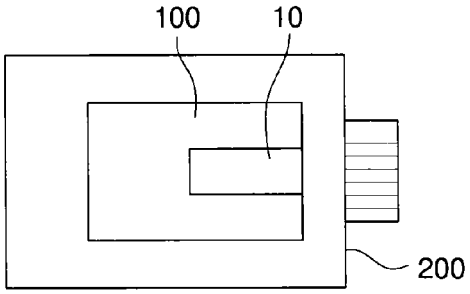
Fig. 8

TIMEPIECE LEVER

This application claims priority from European Patent application No. 14168330.0 filed May 14, 2014, the entire disclosure of which is hereby incorporated herein by reference.

FIELD OF THE INVENTION

The invention concerns a timepiece lever for the transmission of motion between, on the one hand, a transmitter wheel set which is comprised in said lever and mounted to pivot about a first rotational axis, and on the other hand, at least one receiver wheel set external to said lever and pivoting about a second rotational axis distinct from said first rotational axis, said lever including, remote from said first rotational axis, at least one transmission means including at least one control finger-piece or at least one transmission wheel set, the angular position of said at least one transmission means relative to said first rotational axis being variable, said lever including a pivoting plate carrying said at least one transmission means, and including a frictional connection between a first friction surface of said transmitter wheel set and a second friction surface of said pivoting plate.

The invention also concerns a timepiece mechanism including a main plate about which pivots at least one such lever about a said first rotational axis, and at least one receiver wheel set pivoting about a second rotational axis distinct from said first rotational axis and arranged to cooperate with at least one said transmission means of said lever.

The invention also concerns a timepiece movement including at least such mechanism.

The invention also concerns a timepiece or watch including at least one such movement and/or at least one such mechanism.

The invention concerns the field of timepiece mechanisms.

BACKGROUND OF THE INVENTION

Levers are essential components in timepiece movements, enabling a mechanism to switch between several different modes, in general between two distinct positions. A timepiece lever is often accompanied by a return spring to ensure that motion is properly transmitted or support is maintained, depending on the case.

GB Patent Application No 1365428A in the name of CITIZEN discloses a corrector wheel pawl frictionally held between two elastic lever arms.

CH Patent Application No 706266A2 in the name of OMEGA discloses a sliding lever, wherein an intermediate lever wheel and a correction star are linked to each other by a friction spring, with calibration; the friction mainly concerns the driving of the corrector pinion by the intermediate wheel, the lever acts merely as a support.

EP Patent Application No 2701014A1 in the name of ROLEX discloses a configuration with three wheel sets, with two types of stop members, and the clamping of a wheel arbor by elastic return means on a lever.

FR Patent No 2144826 in the name of SEIKO discloses a transmission pinion held between two oscillating lever arms, the arbor of the adjustment pinion being frictionally connected to an arbor of the set of pinions by an oscillating lever, which is only possible if there is a frictional connection both between the pinion and the bore of the oscillating lever that receives it, and between the wheel set and the oscillating lever: there is a frictional connection between the lever and the wheel set arbor, which means that both lever arms clamp the arbor in an elastic manner.

SUMMARY OF THE INVENTION

The invention proposes to provide a lever that does not require a return spring and is autonomous in its operation.

To this end, the invention concerns a timepiece lever according to claim 1.

The invention also concerns a timepiece mechanism according to claim 12.

The invention also concerns a timepiece movement including at least such mechanism.

The invention also concerns a timepiece or watch including at least one such movement and/or at least one such mechanism.

Owing to the invention, the switching between the various positions is achieved by a control mechanism, or directly by a user through action on a stem, a crown, a push-piece, a pull-piece or similar element, with no risk of damaging a component, due to the presence of at least one friction part in the lever according to the invention. This friction also permits rotation of the mechanism when the lever is in place.

BRIEF DESCRIPTION OF THE DRAWINGS

Other features and advantages of the invention will appear upon reading the following detailed description, with reference to the annexed drawings, in which:

FIG. 3 shows a schematic, plan view of a first variant of a pivoting plate comprised in the lever according to the invention, including two friction-generating elastic strips.

FIG. 4 shows a schematic, plan view of a first variant of a transmitter wheel set cooperating with the plate of FIG. 3, including a wheel and a bearing surface of revolution forming a friction surface.

FIG. 5 shows a schematic, plan view of a second variant of a transmitter wheel set, including a wheel and an elastic sleeve including a friction surface.

FIG. 6 shows a schematic, plan view of a second variant of a pivoting plate comprised in the lever according to the invention, cooperating with the transmitter wheel set of FIG. 5, including a female bearing surface of revolution frictionally cooperating with the elastic sleeve.

FIG. 7 shows a schematic, plan view of another variant of the mechanism according to the invention, wherein the transmitter and receiver wheel sets are cams, wherein the lever includes a control finger-piece for an output cam, and wherein the lever includes a pivoting plate arranged in a similar manner to that of FIG. 2, and including an elastic strip generating friction with the bearing surface of a trunnion integral with an input cam.

FIG. 8 is a block diagram showing a watch including a movement integrating a mechanism according to the invention.

DETAILED DESCRIPTION OF PREFERRED EMBODIMENTS

The invention concerns the field of timepiece mechanisms, and more specifically control and motion transmission mechanisms.

The invention more particularly concerns a timepiece lever 1 for the transmission of motion between, on the one hand, a transmitter wheel set 2 which is comprised in lever 1 and mounted to pivot about a first rotational axis D1, and on the other hand, at least one receiver wheel set 3 external to said lever and pivoting about a second rotational axis D2 distinct from first rotational axis D1.

Figure 1:
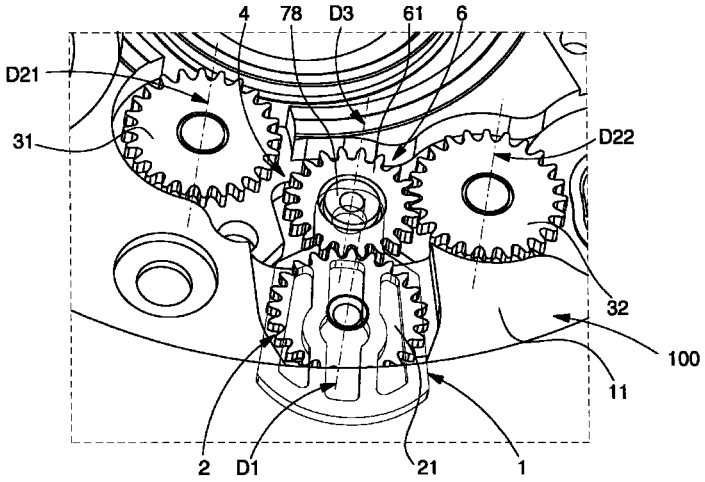
FIG. 1 shows a schematic view, from a first side of a main plate called the top side, of a mechanism according to the invention, with a lever mounted to pivot between two receiver mechanisms, in a position of mesh with one of said mechanisms.
Figure 2:
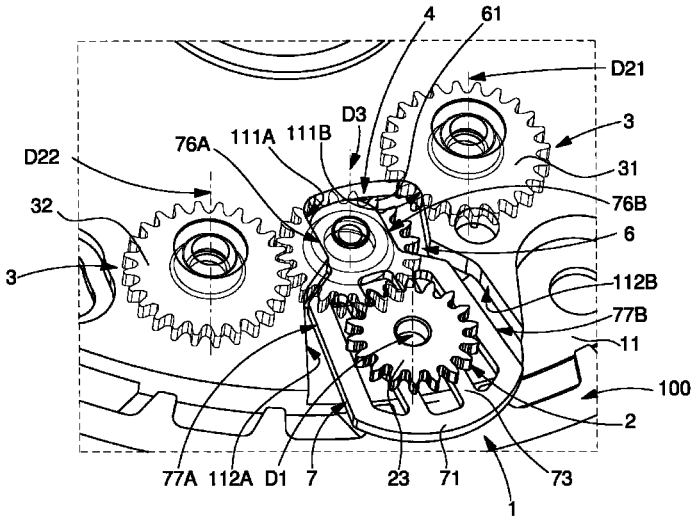
FIG. 2 similarly shows the same mechanism viewed from the second side of the main plate, called the bottom side.

This lever 1 includes, remote from first rotational axis D1, at least one transmission means 4 including at least one control finger-piece 5 as seen in FIG. 7, or at least one transmission wheel set 6, as seen in FIGS. 1 and 2.

The angular position of this at least one transmission means 4 is variable relative to first rotational axis D1.

Lever 1 includes a pivoting plate 7 carrying this at least one transmission means 4. Lever 1 includes a frictional connection between a first friction surface 8 of transmitter wheel set 2 and a second friction surface 9 of pivoting plate 7.

In the embodiment illustrated in FIGS. 1 to 4, the first friction surface 8 is a bearing surface of revolution 81 of transmitter wheel set 2 which may be cylindrical, or conical, or other, and second friction surface 9 includes the lateral surfaces of a groove 72 bordered by at least one elastic strip 73 and comprised in pivoting plate 7. Preferably, this groove 72 is bordered by two elastic strips 73 as seen in FIG. 3.

In a reverse configuration, as seen in FIGS. 5 and 6, the first friction surface 8 is a surface of an elastic sleeve 82 carried by transmitter wheel set 2, and the second friction surface 9 is a bore 74 comprised in pivoting plate 7, and/or the lateral surfaces of a groove 75 comprised in pivoting plate 7. Naturally, bore 74 may also be a full bore, simply made in plate 7. Several configurations may be envisaged for implementation of the invention:

the element carrying first friction surface 8 is elastic and the element carrying second friction surface 9 is rigid;

the element carrying first friction surface 8 is elastic and the element carrying second friction surface 9 is elastic;

the element carrying first friction surface 8 is rigid and the element carrying second friction surface 9 is elastic.

In the embodiment of FIGS. 1 and 2, transmission means 4 includes at least one such transmission wheel set 6 mounted to pivot about a third rotational axis D3 distinct from first rotational axis D1.

Preferably, this transmission wheel set 6 includes at least one sliding wheel 61 pivotally movable on an arbor 78.

In an economical embodiment, this arbor 78 is integral with pivoting plate 7, in the form of an integrally processed or machined, or bonded, or welded, or riveted, or similar trunnion.

In the variant illustrated in FIG. 1, transmitter wheel set 2 includes at least a first wheel 21 meshing with sliding wheel 61.

Advantageously, transmitter wheel set 2 includes, on either side of pivoting plate 7, a first wheel 21 or a first control member 22 on a first side 71 of pivoting plate 7, and a second wheel 23 or a second control member 24 on a second side 72 of pivoting plate 7. In this embodiment of FIGS. 1 and 2, transmitter wheel set 2 thus includes, on either side of pivoting plate 7, such a first wheel 21 on a first side 71 of pivoting plate 7, and such a second wheel 23 on a second side 72 of pivoting plate 7, the first wheel 21 and second wheel 23 rotating integrally, and one of them meshing with a sliding wheel 61 comprised in such a transmission wheel set 6 comprised in transmission means 4.

In another variant embodiment, groove 72 has parallel faces, and clamps the element carrying complementary surface 81 in every position over the length of groove 72. The position of axis D1 is, thus, movable relative to axis D3, except when it is in a particular snap fit position in the open bore intersecting the groove in its middle in FIG. 3. It is, therefore, possible to use lever 1 in a mechanism that controls an axial motion of lever 1 by pushing or pulling the pivoting plate in the direction of groove 72 until the engaged position is reached when control then also affects transmitter wheel set 2.

The invention also concerns a timepiece mechanism 10 including a main plate 11 about which pivots at least one such lever 1 about a said first rotational axis D1, and at least one receiver wheel set 3 pivoting about a second rotational axis D2 distinct from the first rotational axis D1 and arranged to cooperate with at least one such transmission means 4 of lever 1.

Preferably, this mechanism 10 includes, on either side of lever 1, a first receiver wheel set 31 with a third rotational axis D21 and a second receiver wheel set 32 with a fourth rotational axis D22, and at most one of which is in mesh, at any given time, with such a transmission means 4 of lever 1.

In the preferred embodiment of FIGS. 1 and 2, the first receiver wheel set 31 and second receiver wheel set 32 are wheels arranged to cooperate, one at a time, with a sliding wheel 61 comprised in such a transmission wheel set 6 comprised in transmission means 4.

As seen in FIG. 2, main plate 11 advantageously includes main plate stop surfaces 11A, 11B and/or 112A, 112B, which are arranged to cooperate with lever stop surfaces 76A, 76B and/or respectively 77A, 77B, to limit the angular clearance of pivoting plate 7 relative to main plate 11, and to limit the shake between, on the one hand, transmission means 4 carried by lever 1, and on the other hand, the at least one receiver wheel set 3. This arrangement is particularly advantageous when mechanism 10 implements toothed wheels, since it therefore limits the shake of the teeth.

In a particular embodiment that is not illustrated, mechanism 10 includes, between main plate 11 and lever 1, at least one elastic return means for subjecting lever 1 to a force tending to pivot it in a preferred direction.

The motion command of said at least one receiver wheel set 3 is imparted, either to pivoting plate 7 of lever 1, or to transmitter wheel set 2 comprised in lever 1.

In a particular and non-limiting embodiment, mechanism 10 includes a first receiver wheel set 31 which is a correction wheel set for a date mechanism, and a second receiver wheel set 32 which is a correction wheel set for a moon phase mechanism. Thus, operation by a user in position II of a normal watch control stem permits correction of the date in a first direction of rotation, and correction of the moon phase in the opposite direction.

Naturally, other complications can be controlled in a similar manner with the aid of the lever of the invention.

The invention also concerns a timepiece movement 100 including at least one such mechanism 10.

The invention also concerns a timepiece 200 or watch including at least one such movement 100, and/or at least one such mechanism 10.

Naturally, although the invention is described within a particular use wherein the input command is given by the input wheel set 2 or by pivoting plate 7 to transmit motion to one of the receiver wheel sets 3, it is clear that such a mechanism 10 can be used in reverse mode with an input on the side of one of wheel sets 3 and an output towards wheel set 2 or plate 7.

The invention has multiple advantages:

the lever operates without a return spring;

in an embodiment including toothed wheels, as illustrated in FIGS. 1 and 2, or similar, one advantage of the invention is that, during engagement on one side of the lever or the other, the force always tends to push the wheels against each other, in a constant manner. Good engagement is therefore facilitated, while also preventing any inadvertent disengagement or so-called grating of the system;

when the input transmitter wheel set of the lever is kinematically connected to a stem operated by the user, for example via a sliding pinion which engages directly with input wheel 23, switching between two positions occurs under the action of the force imparted by the user to the stem, but with no risk of breaking a component, due to friction;

the system is more compact than a friction brake; it allows transmission of high torque compatible with all timepiece functions;

the machining of the pivoting plate is not complex: its design is well suited to a silicon realization, by means of MEMS or LIGA or similar processes, or to production by means of stamping or similar.

What is claimed is:

1. A timepiece lever for transmission of motion between a transmitter wheel set, which is comprised in said lever and mounted to pivot about a first rotational axis, and at least one receiver wheel set external to said lever and pivoting about a second rotational axis distinct from said first rotational axis, said lever comprising:

remote from said first rotational axis, at least one transmission mechanism including at least one control fingerpiece or at least one transmission wheel set, an angular position of said at least one transmission mechanism being variable relative to said first rotational axis, a pivoting plate carrying said at least one transmission mechanism, and a frictional connection between a first friction surface of said transmitter wheel set and a second friction surface of said pivoting plate, wherein an element carrying said first friction surface is elastic and wherein an element carrying said second friction surface is elastic.

2. The lever according to claim 1, wherein said first friction surface is a bearing surface of revolution of said transmitter wheel set and wherein said second friction surface includes lateral surfaces of a groove bordered by at least one elastic strip and comprised in said pivoting plate.

3. The lever according to claim 1, wherein said first friction surface is a surface of an elastic sleeve carried by said transmitter wheel set, and wherein said second friction surface is a bore comprised in said pivoting plate or lateral surfaces of a groove comprised in said pivoting plate.

4. The lever according to claim 1, wherein said transmission mechanism includes at least one said transmission wheel set mounted to pivot about a third rotational axis distinct from said first rotational axis.

5. The lever according to claim 4, wherein said transmission wheel set includes at least one sliding wheel pivotally movable on an arbor.

6. The lever according to claim 5, wherein said arbor is integral with said pivoting plate.

7. The lever according to claim 5, wherein said transmitter wheel set includes at least a first wheel engaging with said sliding wheel.

8. The lever according to claim 1, wherein said transmitter wheel set includes, on either side of said pivoting plate, a first wheel or a first control member on a first side of said pivoting plate, and a second wheel or a second control member on a second side of said pivoting plate.

9. The lever according to claim 8, wherein said transmitter wheel set includes, on either side of said pivoting plate, said first wheel on the first side of said pivoting plate, and a said second wheel on the second side of said pivoting plate, said first wheel and said second wheel rotating integrally, and one of said first and second wheels meshing with a sliding wheel comprised in a said transmission wheel set comprised in said transmission mechanism.

10. A timepiece mechanism comprising:

a main plate about which pivots at least one said lever according to claim 1 about said first rotational axis, and at least one said receiver wheel set pivoting about said second rotational axis distinct from said first rotational axis and arranged to cooperate with at least one said transmission mechanism of said lever.

11. The timepiece mechanism according to claim 10, wherein said timepiece mechanism includes, on either side of said lever, a first receiver wheel set with a third rotational axis and a second receiver wheel set with a fourth rotational axis, and at most one of which is in mesh, at any given time, with said transmission mechanism of said lever.

12. The timepiece mechanism according to claim 11, wherein said first receiver wheel set and said second receiver wheel set are wheels arranged to cooperate, one at a time, with a sliding wheel comprised in a said transmission wheel set comprised in said transmission mechanism.

13. The timepiece mechanism according to claim 10, wherein said main plate includes main plate stop surfaces, which are arranged to cooperate with lever stop surfaces, to limit an angular clearance of said pivoting plate relative to said main plate, and to limit a shake between said transmission mechanism carried by said lever and said at least one receiver wheel set.

14. The timepiece mechanism according to claim 10, wherein said timepiece mechanism includes, between said main plate and said lever, at least one elastic return mechanism to subject said lever to a force tending to pivot the lever in a preferred direction.

15. The timepiece mechanism according to claim 10, wherein a motion command from said at least one receiver wheel set is imparted, either to said pivoting plate of said lever, or to said transmitter wheel set comprised in said lever.

16. The timepiece mechanism according to claim 11, wherein said first receiver wheel set is a correction wheel set for a date mechanism, and wherein said second receiver wheel set is a correction wheel set for a moon phase mechanism.

17. A timepiece movement comprising:

at least one timepiece mechanism according to claim 10.

18. A timepiece or watch, comprising:

at least one timepiece mechanism according to claim 10.

19. A timepiece lever for transmission of motion between a transmitter wheel set, which is comprised in said lever and mounted to pivot about a first rotational axis, and at least one receiver wheel set external to said lever and pivoting about a second rotational axis distinct from said first rotational axis, said lever comprising:

remote from said first rotational axis, at least one transmission mechanism including at least one control fingerpiece or at least one transmission wheel set, an angular position of said at least one transmission mechanism being variable relative to said first rotational axis, a pivoting plate carrying said at least one transmission mechanism, and a frictional connection between a first friction surface of said transmitter wheel set and a second friction surface of said pivoting plate, wherein an element carrying said first friction surface is elastic and wherein an element carrying said second friction surface is rigid.

20. A timepiece lever for transmission of motion between a transmitter wheel set, which is comprised in said lever and mounted to pivot about a first rotational axis, and at least one receiver wheel set external to said lever and pivoting about a second rotational axis distinct from said first rotational axis, said lever comprising:

remote from said first rotational axis, at least one transmission mechanism including at least one control fingerpiece or at least one transmission wheel set, an angular position of said at least one transmission mechanism being variable relative to said first rotational axis, a pivoting plate carrying said at least one transmission mechanism, and a frictional connection between a first friction surface of said transmitter wheel set and a second friction surface of said pivoting plate, wherein an element carrying said first friction surface is rigid and wherein an element carrying said second friction surface is elastic.

* * * * *